US010611521B1

(12) United States Patent
Piernot et al.

(10) Patent No.: US 10,611,521 B1
(45) Date of Patent: Apr. 7, 2020

(54) DEPTH ADJUSTABLE CONTAINER

(71) Applicants: Scott Piernot, Cross Plains, WI (US); Calvin Zick, Cross Plains, WI (US)

(72) Inventors: Scott Piernot, Cross Plains, WI (US); Calvin Zick, Cross Plains, WI (US)

( * ) Notice: Subject to any disclaimer, the term of this patent is extended or adjusted under 35 U.S.C. 154(b) by 43 days.

(21) Appl. No.: 15/927,569

(22) Filed: Mar. 21, 2018

Related U.S. Application Data

(60) Provisional application No. 62/475,359, filed on Mar. 23, 2017.

(51) Int. Cl.

| | |
|---|---|
| ***B65D 21/08*** | (2006.01) |
| *B65D 3/04* | (2006.01) |
| *B65D 21/06* | (2006.01) |
| *B65D 21/02* | (2006.01) |

(52) U.S. Cl.
CPC ..... *B65D 21/086* (2013.01); *B65D 3/04* (2013.01); *B65D 21/0228* (2013.01); *B65D 21/068* (2013.01); *B65D 21/083* (2013.01)

(58) Field of Classification Search
CPC .. B65D 21/086; B65D 21/08; B65D 21/0228; B65D 21/0209; B65D 21/02; B65D 21/068; B65D 21/06; B65D 21/083; B65D 81/3227; B65D 81/32; B65D 5/48; B65D 25/04; B65D 25/08
USPC ..... 220/8, 4.01, 506, 505, 504, 503, 501, 220/23.86, 23.83, 62.13
See application file for complete search history.

(56) References Cited

U.S. PATENT DOCUMENTS

| | | | | |
|---|---|---|---|---|
| 2,416,142 | A | 2/1947 | Bennett | |
| 5,370,250 | A | 12/1994 | Gilbert | |
| 5,785,409 | A | 7/1998 | Reinert, Sr. | |
| 6,116,448 | A | 9/2000 | Fragos | |
| 6,484,897 | B1 | 11/2002 | Crawley | |
| 7,090,183 | B2 | 8/2006 | Heybl et al. | |
| 2002/0130126 | A1* | 9/2002 | Rosenberg | B65D 21/083 220/4.26 |
| 2004/0069740 | A1 | 4/2004 | Athalye | |
| 2008/0245789 | A1 | 10/2008 | Hudecki | |
| 2010/0012658 | A1* | 1/2010 | Karangelen | B65D 25/04 220/500 |
| 2011/0076362 | A1* | 3/2011 | Holtrop | B65D 21/083 426/87 |

* cited by examiner

*Primary Examiner* — Robert J Hicks
(74) *Attorney, Agent, or Firm* — Cramer Patent & Design, PLLC; Aaron R. Cramer

(57) ABSTRACT

A container includes a container body including a tubular sidewall. The container body also includes a first section including first thread formed in the tubular sidewall, a second section including second thread formed in the tubular sidewall, and a separation line formed in the sidewall defining the first section and the second section of the container body. The container body is configured to separate along the separation line. With the first section and the second section separated from one another, the first section is receivable by the second section and the first threads mate with the second threads. A length of the container body is adjustable by rotation of the first section relative to the second section.

20 Claims, 5 Drawing Sheets

DEPTH ADJUSTABLE CONTAINER

RELATED APPLICATIONS

The present invention claims the benefit of U.S. Provisional Application No. 62/475,359 filed on Mar. 23, 2017, the entire disclosures of which are incorporated herein by reference.

FIELD OF THE INVENTION

The present invention relates to containers and, more particularly, to a depth adjustable container suited for holding, packaging, and storing goods or products.

BACKGROUND OF THE INVENTION

Potato chips are one (1) of the more popular snack foods. They can be found almost worldwide, anywhere from picnics to parties, to sporting events, to homes, and even in fancy restaurants. One (1) particular type of potato chip, the processed potato chip, such as Pringles®, has found a loyal following among consumers as well. While their taste may be a big part of their success, a certain portion of it must be attributed to their stackable configuration inside of a cylindrical container. While such a container certainly protects the chips inside, it is somewhat difficult to get the chips out, especially those at the bottom. Most are forced to shake the bottom chips out, possibly causing them to break and/or cause a mess in the case of an accidental spill. If one's hand in small enough, they can reach inside, but risk getting their hand and entire lower arm soiled. Accordingly, there exists a need for an improved packaging container for processed potato chips without the disadvantages as listed above.

SUMMARY OF THE INVENTION

The inventor has recognized the aforementioned, inherent problems and lack in the art and observed that there is a need for a new and improved container for stackable food products. The development of the present invention, which will be described in greater detail herein, fulfills this need.

In an embodiment, the disclosed container includes a container body including an upstanding, tubular sidewall having a first end and a second end. The container also includes a first threaded section formed in the sidewall and located adjacent the first end, a second threaded section formed in the sidewall and located adjacent the second end, and a separation line formed in the sidewall between the first threaded section and the second threaded sections. The container also includes a first end closure connected to the first end of the container body and a second end closure connected to the second end of the container body. The container also includes a barrier film connected to an inner surface of the sidewall. The container also includes a label connected to an outer surface of the sidewall. The container also includes a lid. The first threaded section is capable of mating with the second threaded section. The container body is capable of holding product in a stacked configuration.

In another embodiment, the disclosed container includes a container body including a tubular sidewall. The container body also includes a first section including first thread formed in the tubular sidewall, a second section including second thread formed in the tubular sidewall, and a separation line formed in the sidewall defining the first section and the second section of the container body. The container body is configured to separate along the separation line. With the first section and the second section separated from one another, the first section is receivable by the second section and the first threads mate with the second threads. A length of the container body is adjustable by rotation of the first section relative to the second section.

In an embodiment, the disclosed method for making a container includes steps of: 1). forming a container blank; 2). forming first threads in the container blank; 3). forming second threads in the container blank; and 4). forming a separation line in the container blank to define a first section having the first threads and a second section having the second threads.

Furthermore, the features and advantages described herein may be combined in various manners and embodiments as one skilled in the relevant art will recognize. The embodiment and examples disclosed herein can be practiced without one (1) or more of the features and advantages described in a particular embodiment or example.

Further advantages of the embodiments and examples disclosed herein will become apparent from a consideration of the drawings and ensuing description.

BRIEF DESCRIPTION OF THE DRAWINGS

The advantages and features of the embodiments and examples disclosed herein will become better understood with reference to the following more detailed description and claims taken in conjunction with the accompanying drawings, in which like elements are identified with like symbols, and in which:

DESCRIPTIVE KEY

Figure 1:
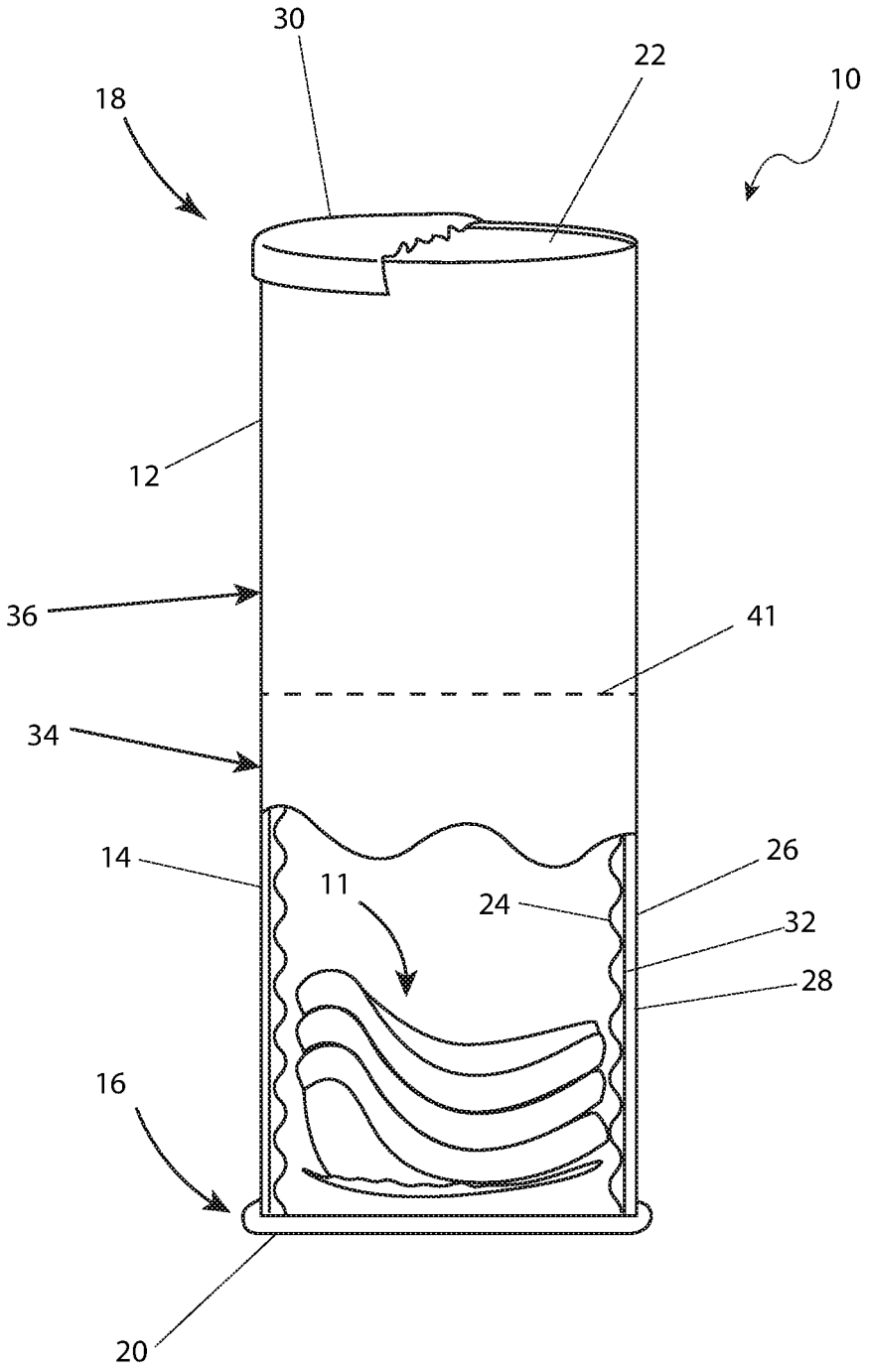
FIG. 1 is a front view of an embodiment of the disclosed depth adjustable container.

10 depth adjustable container ("container")
11 product
12 container body
14 sidewall
14A lower sidewall
14B upper sidewall
16 lower end
18 upper end
20 lower end closure
22 upper end closure
24 interior surface
26 exterior surface
28 label
30 cover lid
32 barrier film

34 lower section
36 upper section
38 lower thread
40 upper thread
41 separation line
42 lower sidewall-free end
44 upper sidewall-free end
46 container body blank
48 sidewall material
50 mandrel
52 first roller
54 second roller
56 third roller
58 lower portion
60 upper portion
100 method

DETAILED DESCRIPTION OF THE PREFERRED EMBODIMENT

In accordance with the invention, the best mode is presented in terms of the illustrative example embodiments, herein depicted within FIGS. 1-7. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one (1) particular configuration may be shown and described for purposes of clarity and disclosure and not by way of limitation of scope.

As used herein, the singular terms "a," "an," and "the" include plural referents unless the context clearly dictates otherwise. Thus, for example, reference to an object can include multiple objects unless the context clearly dictates otherwise.

As used herein, the terms "connect," "connected," and "connection" refer to a coupling or linking. Connected objects can be directly coupled to one (1) another or can be indirectly coupled to one (1) another, such as via another object.

As used herein, the terms "first," "second," etc. are used merely as labels and do not impose any positional or hierarchical requirements on the item to which the term refers.

Referring to FIGS. 1-7, disclosing depth adjustable container for goods or products, herein generally referred to as the "container" 10, where like reference numerals represent similar or like parts. Generally, the container 10 is a packaging and/or storage container for holding perishable and/or non-perishable goods or products, generally referred to herein as "product" 11, from manufacture, through shipment, to sale to a consumer for consumption. The container 10 is particularly useful for dispensing the product 11, for example, when the product 11 has become difficult to access as the product is removed, used or otherwise depleted from within the container 10 or where tilting or overturning the container 10 to dispense the product 11 becomes a problem because of spillage or breakage of the product 11. The disclosed container 10 may also be sold by itself, for example, as a standalone storage container for products 11 that become difficult to access as the product 11 is used (e.g., as portions of the product 11 are removed from the container 10).

FIG. 1 is a schematic illustration of a perspective view, partially broken away, of an example embodiment of the disclosed container 10. Generally, the container 10 includes a container body 12 having an upstanding, tubular sidewall 14 of an approximately cylindrical cross section. The container body 12 is closed at its ends (a first, or lower (bottom), end 16 and an opposed second, or upper (top), end 18) by end closures (a first, or lower (bottom), end closure 20 and a second, or upper (top), end closure 22).

The product 11 may be any good, foodstuff or other perishable or non-perishable product. As a general, non-limiting example, the product 11 may include snack food products, such as chips, nuts, candy, and the like. As another general, non-limiting example, the product 11 may include condiments, such as peanut butter, salsa, sauces and the like. As a specific, non-limiting example, the product 11 (e.g., a perishable product) may be a snack food product 11 packaged by the container 10, for example, in chip form (e.g., chips). In this example, the product 11 (e.g., chips) are typically a potato-based snack food product. As examples, the product 11 may be manufactured in accordance with U.S. Pat. No. 2,228,644, entitled Method and Apparatus for Processing Potatoes, granted on Jun. 16, 1942 to Pringle et al. and U.S. Pat. No. 3,998,975, entitled Potato Chip Products and Process for Making Same, granted on Dec. 21, 1976 to Liepa, the entire contents of which are hereby incorporated by reference. However, the chips may also be wheat-based, corn-based and/or include various other ingredients. The product 11 (e.g., chips) used are of a non-planar shape and are formed into a desired curved shape in a uniform manner to permit the chip-type product 11 to be stacked upon the other to form a grouped array and, thereby, minimize the void space between individual ones of the chip-type product 11. As an example, the product 11 (e.g., chips) have a consistent saddle shape, such as PRINGLES® brand snack chips sold by The Kellogg Company. The product 11 (e.g., chips) are stacked one (1) upon the other with corresponding surfaces similarly oriented and are then placed in the container 10 (i.e., within the container body 12), which is configured to enclose the stack of closely packed chips.

The tubular sidewall 14 of the container body 12 may be constructed of any suitable or conventional materials, but it is preferably made from materials that are sufficiently rigid to withstand handling and shipping loads and substantially impervious to the passage of gasses, such that oxygen and/or water vapor are precluded from entering the container 10 and causing rancidity and/or staling of the product 11 (e.g., perishable product).

In an example embodiment, the sidewall 14 may be formed from a fiber material structure. As examples, a suitable fiber structure for the construction of the sidewall 14 may include craft paper, paperboard, cardstock, cardboard, and other types of paper products or combinations thereof.

In this embodiment, the container body 12 (e.g., the sidewall 14) may also include a barrier film 32, that is coupled to a surface (e.g., a first, or interior (inside), surface 24 or a second, or exterior (outside), surface 26) of the fiber structure (e.g., the sidewall 14) to provide a sufficient barrier to the passage of oxygen and/or water vapor through the sidewall 14. In an example embodiment, the barrier film 32 may include a layer of metallic foil, a polymer film, or the like. As an example, the metallic foil may be aluminum foil that is adhered (e.g., by an adhesive) to the sidewall 14 to provide the oxygen and/or water vapor barrier. As an example, the polymer film may be a polyethylene or polypropylene film that is adhered (e.g., by an adhesive) to the sidewall 14 to provide the oxygen and/or water vapor barrier.

Optionally, one (1) or both surfaces of the fiber (e.g., paperboard) sidewall 14 may include (e.g., may be coated with) a polymer (e.g., polyethylene or polypropylene) coating. The polymer coating may provide an additional barrier in the event the metallic foil should develop any pinholes.

Optionally, outside surfaces of the fiber (e.g., paperboard) sidewall 14 and the metallic foil may include (e.g., may be laminated together with) a polymer (e.g., polyethylene or polypropylene) film. The polymer film may provide an additional barrier in the event the metallic foil should develop any pinholes and may also provide a resilient coating for the metallic foil to protect it from surface scratches and the like.

In another example embodiment (not illustrated), the sidewall 14, or the container body 12, may be formed from a metallic, tin (e.g., tinplate), aluminum, or plastic structure. These materials are commonly used in the manufacture of tin and aluminum cans and plastic containers. As an example, the sidewall 14 (or the entire container body 12) may be made from a thin sheet of steel coated on both sides with tin (e.g., tinplate or tin-coated steel) or a thin sheet of aluminum, as is well known in the art. As another example, the sidewall 14 (or the entire container body 12) may be made from thermoplastic or other polymeric material, as is well known in the art.

A label 28, or merchandizing wrap, may be adhered or otherwise coupled to the outside (e.g., exterior surface 26) of the sidewall 14. As an example, the label 28 may be paper or other wrapping substrate or material that has been printed to indicate the name and the character of the product 11 packaged within the container 10. Alternatively, as another example, the label 28 may be a printed foil label or other merchandising wrap. The foil label 28 may provide an additional barrier to the passage of oxygen and/or water vapor and results in an attractive, metallic appearance.

In an example embodiment, the end closure members (the lower end closure 20 and the upper end closure 22) may be secured to the container body 12 (e.g., the sidewall 14) by crimping to provide a tight, hermetic seal to the container 10. As an example, each end closure may include a sealing member having a flange with an outer diameter greater than the sidewall 14 at its respective end. The sealing member is recessed and lies in a plane spaced from a plane in which the flange lies. Each end closure is placed on an open end of the sidewall 14 with the right angle formed by the spacing of the recessed portion of the sealing member and the flange being positioned to provide a snug fit with the interior surface 24 of sidewall 14. The flange is then crimped by rolling it over a perimeter edge of the open end of the sidewall 14. In an example embodiment, the upper end closure 22 may be provided with a pull-tab and/or have a score line thereon defining a tearable opening strip for removal of the upper end closure 22 from the container body 12. In this embodiment, the upper end closure 22 may be made of aluminum or tinplate to facilitate the tearing and removal thereof. The lower end closure 20 may be made of aluminum or tinplate.

In another example embodiment, the upper end closure 22 may be secured to the container body 12 (e.g., the sidewall 14) by adhering the upper end closure 22 to provide a tight, hermetic seal to the container 10. As an example, the upper end closure 22 may include a sealing member having an outer diameter greater than the open end of the sidewall 14 at its respective upper end 18 of the container body 12. The upper end closure 22 is placed on the open end of the sidewall 14. A peripheral section of the upper end closure 22 (e.g., proximate a perimeter of the sealing member) is then adhered to the perimeter edge of the open end of the sidewall 14. In an example embodiment, the upper end closure 22 may be provided with a pull-tab for removal of the upper end closure 22 from the container body 12. In this embodiment, the upper end closure 22 may be made of a thin plastic sheet material (e.g., cellophane).

In an example embodiment, the container 10 also includes a cover lid 30. The product 11 can be conveniently and repeatedly accessed and resealed. The cover lid 30 may be injection molded of polyethylene, polypropylene, or the like and will assist in keeping the product 11 fresh by tending to reduce the amount of additional oxygen or water vapor that enters the container body 12 after it has been initially opened.

The container 10 (e.g., the container body 12) is depth, or height or length, adjustable. As an example, the overall internal depth, or external height or length, (e.g., a longitudinal dimension) of the container body 12 is configured to be reduced (e.g., the container 10 is configured to reduce in size or collapse) as product 11 is removed from the container body 12.

Figure 2:
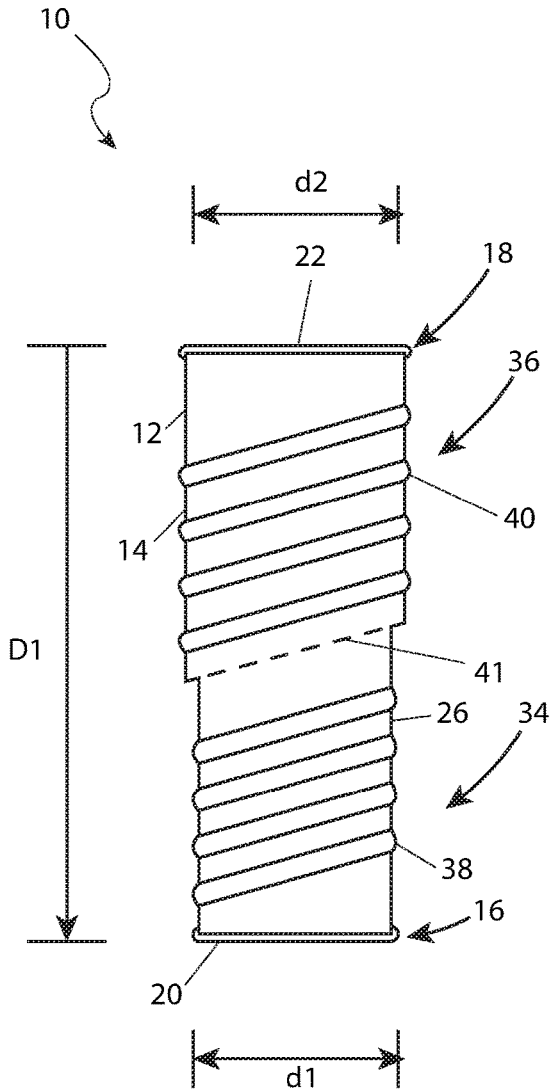
FIG. 2 is a side elevation view of an embodiment of the disclosed depth adjustable container showing an original depth.

FIG. 2 is a schematic illustration of a side view of an embodiment of the container body 12 of the disclosed container 10 having an original depth D1 (or height). FIG. 2 illustrates the basic design for the function and operation of the disclosed container 10. In an example embodiment, the container body 12 and, thus, the tubular sidewall 14, includes a first, or lower, section 34 and a second, or upper, section 36. The lower section 34 of the container body 12 includes a first, or lower, thread 38 formed in the sidewall 14. The upper section 36 of the container body 12 includes a second, or upper, thread 40 formed in the sidewall 14.

The container body 12 also includes a separation line 41, or perforation line, formed in the sidewall 14 defining a line of delineation between the lower section 34 and the upper section 36. The container body 12 is configured to be separated along the separation line 41 such that the lower section 34 of the container body 12 separates (or breaks free from) the upper section 36 of the container body 12 and, thereby, defining a tubular first, or lower (inner), sidewall 14A and a tubular second, or upper (outer), sidewall 14B. In another embodiment, the lower wall 14A, or lower section 34, and upper wall 14B, or the upper section 36, are interchangeable in design where one (1) sleeves over the other and vice versa.

As an example, the separation line 41 is formed by perforating or scoring the sidewall 14 of the container body 12. As an example, a circumferential row of small holes or slots may be punched at least partially through the sidewall 14 such that the lower section 34 of the container body 12 and the upper section 36 of the container body 12 can be easily separated along the separation line 41.

As an example, the lower section 34 of the container body 12 and the upper section 36 of the container body 12 may be configured to break free from one (1) another along, or about, the separation line 41 in response to counter rotational forces applied to the lower section 34 of the container body 12 and the upper section 36 of the container body 12 (e.g., by twisting the container body 12 about the separation line 41).

As another example, the lower section 34 of the container body 12 and the upper section 36 of the container body 12 may be configured to break free from one (1) another along, or about, the separation line 41 in response to a bending force applied to the opposed ends of the container body 12 (e.g., by bending the container body 12 about the separation line 41).

In an example embodiment, the lower thread 38 extends spirally or helically around at least a portion of the exterior surface 26 of the sidewall 14 of the lower section 34 of the container body 12 (e.g., the lower sidewall 14A). The lower thread 38 is located between the lower end 16 of the container body 12 and the separation line 41 (or a free end 42 of the lower sidewall 14A). As an example, the lower thread 38 extends from proximate (e.g., at or near) the lower end 16 of the container body 12 to proximate the separation line 41 (or the free end 42 of the lower sidewall 14A). Similarly, the upper thread 40 extends spirally or helically around at least a portion of the exterior surface 26 of the sidewall 14 of the upper section 36 of the container body 12. The upper thread 40 is located between the separation line 41 (or a free end 44 of the upper sidewall 14B) and the upper end 18 of the container body 12. As an example, the upper thread 40 extends from proximate the separation line 41 (or the free end 44 of the upper sidewall 14B) to proximate the upper end 18 of the container body 12. However, it can be appreciated that the upper thread 40 can extend at any distance along this section of the upper section 36 of the container body 12.

Figure 3:
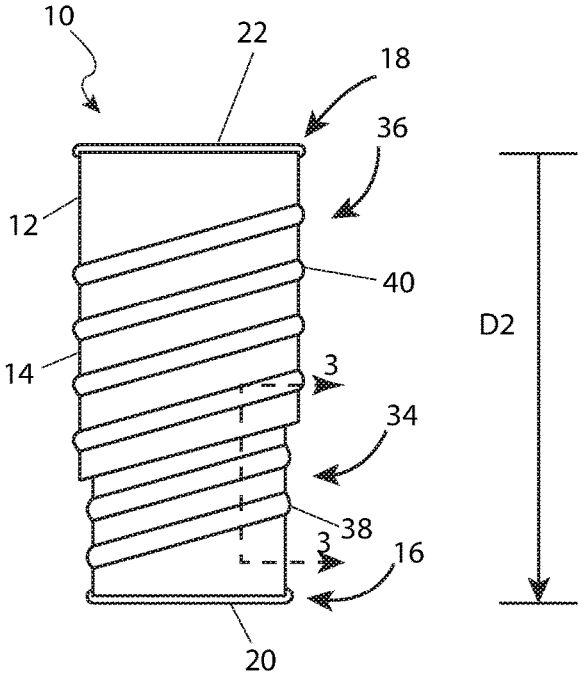
FIG. 3 is a side elevation view of an embodiment of the disclosed depth adjustable container showing an adjusted depth.

FIG. 3 is a schematic illustration of a side view of an embodiment of the container body 12 of the disclosed container 10 having an adjusted depth D2 (or height). FIG. 3 illustrates the container 10 after basic operation of adjusting the depth of the container 10. Upon the lower section 34 of the container body 12 and the upper section 36 of the container body 12 being separated, the lower section 34 of the container body 12 may be received within the upper section 36 of the container body 12 where the lower thread 38 engages and mates with the upper thread 40. Upon engagement of the lower thread 38 and the upper thread 40, the overall depth, or height, of the container 10 may be reduced (e.g., from the original depth D1 to an adjusted depth D2) by rotating one (1) of the lower section 34 of the container body 12 and the upper section 36 of the container body 12 relative to each other (e.g., by screwing the lower section 34 of the container body 12 into the upper section 36 of the container body 12).

Accordingly, as product 11 (FIG. 1) is removed from the container 10, the depth, also referred to herein as a height or a length, of the container body 12 may be adjusted, for example, reduced, to allow access and removal of remaining product 11 located about the lower end 16 of the container 10 (e.g., in the lower section 34 of the container body 12) without the need for tipping the container 10 and pouring product 11 out of the container 10.

Figure 4:
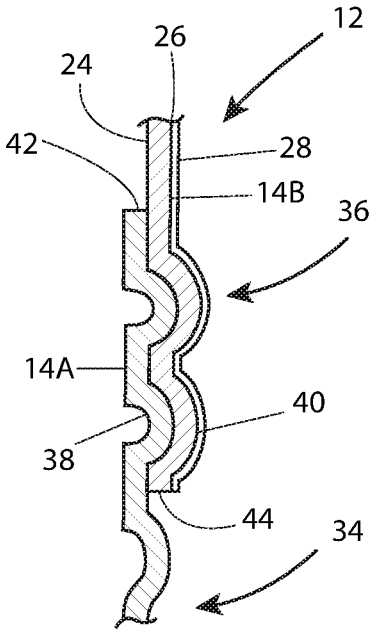
FIG. 4 is a side view, in section, of an embodiment of the disclosed depth adjustable container, taken along section line 3-3 of FIG. 3.

FIG. 4 is a schematic illustration of a partial cross-sectional view of an embodiment of the container body 12 taken along section line 3-3 of FIG. 3. FIG. 4 illustrates an example embodiment of the container 10 and, more specifically, an embodiment of the construction of the sidewall 14 suited for containing non-perishable goods or products (the product 11). The lower thread 38 includes a series of alternating ridges and grooves formed in the sidewall 14 of the lower section 34 of the container body 12 (the lower sidewall 14A). Similarly, the upper thread 40 includes a series of alternating ridges and grooves formed in the sidewall 14 of the upper section 36 of the container body 12 (the upper sidewall 14B). Upon the lower section 34 of the container body 12 being separated from and inserted within the upper section 36 of the container body 12, ridges of the lower thread 38 mate within ridges of the upper thread 40 and grooves of the upper thread 40 mate within grooves of the lower thread 38.

Accordingly, and as illustrated in FIG. 2, the lower section 34 of the container body 12 has an external diameter d1 that is slightly smaller than an external diameter d2 of the upper section 36 of the container body 12. The difference between diameter d1 and diameter d2 is approximately equal to the thickness of the sidewall 14 of the upper section 36 of the container body 12 (the upper sidewall 14B).

Figure 5:
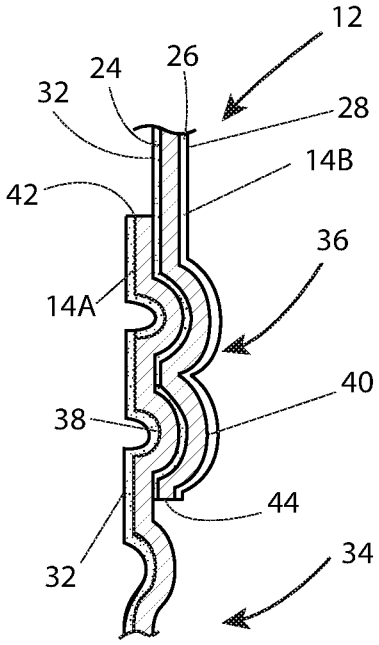
FIG. 5 is a side view, in section, of another embodiment of the disclosed depth adjustable container taken along section line 3-3 of FIG. 3.

FIG. 5 is a schematic illustration of a partial cross-sectional view of another embodiment of the container body 12 taken along section line 3-3 of FIG. 3. FIG. 5 illustrates an example embodiment of the container 10 and, more specifically, an embodiment of the construction of the sidewall 14 particularly suited for containing perishable goods or products (the product 11). In an example embodiment, the separation line 41 is also formed through the barrier film 32. As an example, the circumferential row of small holes or slots may be punched at least partially through the barrier film 32, such that a lower portion of the barrier film 32 associated with the lower sidewall 14A and an upper portion of the barrier film 32 associated with the upper sidewall 14B can be easily separated along the separation line 41. Accordingly, separation of the lower section 34 of the container body 12 and the upper section 36 of the container body 12 from one (1) another also separates the barrier film 32 along the separation line 41.

Upon the lower section 34 of the container body 12 (the lower sidewall 14A) being received within the upper section 36 of the container body 12 (the upper sidewall 14B), a portion of the barrier film 32 associated with the upper sidewall 14B is positioned between the lower sidewall 14A and the upper sidewall 14B and, thus, also between the mating lower thread 38 and upper thread 40. As such, the barrier film 32 provides a substantially airtight seal between the lower sidewall 14A and the upper sidewall 14B to assist in keeping the product 11 fresh by tending to reduce the amount of additional oxygen or water vapor that enters the container body 12 after the container body 12 and the barrier film 32 have been separated along the separation line 41.

In the example embodiment illustrated in FIG. 5, the barrier film 32 is coupled (e.g., adhered) to the interior surface 24 of the container body 12 (the sidewall 14). However, in other embodiments, the barrier film 32 may be coupled to the exterior surface 26 of the container body 12 (the sidewall 14) with equal results and benefit. In this embodiment, upon the lower section 34 of the container body 12 (the lower sidewall 14A) being received within the upper section 36 of the container body 12 (the upper sidewall 14B), a portion of the barrier film 32 associated with the lower sidewall 14A is positioned between the lower sidewall 14A and the upper sidewall 14B and, thus, also between the mating lower thread 38 and upper thread 40.

In another example embodiment, the barrier film 32 may be coupled to the exterior 26 of the container body 12 and serve as the product label 28 (e.g., the barrier film 32 may be a printed label or merchandising wrap).

In another example embodiment, the barrier film 32 may be coupled to the interior surface 24 of the container body 12 (the sidewall 14) as illustrated in FIG. 5. A printed label 28 may be coupled to the exterior 26 of the container body 12. In this example embodiment, the separation line 41 may also be formed through the label 28. Upon the lower section 34 of the container body 12 (the lower sidewall 14A) being received within the upper section 36 of the container body 12 (the upper sidewall 14B), a portion of the barrier film 32 associated with the upper sidewall 14B and a portion of the label 28 associated with the lower sidewall 14A are positioned between the lower sidewall 14A and the upper sidewall 14B and, thus, also between the mating lower thread 38 and upper thread 40. As such, the barrier film 32 and the label 28 provide a substantially airtight seal between the lower sidewall 14A and the upper sidewall 14B to assist in keeping the product 11 fresh by tending to reduce the amount of additional oxygen or water vapor that enters the container body 12 after the container body 12, the barrier film 32, and the label 28 have been separated along the separation line 41.

Figure 6:
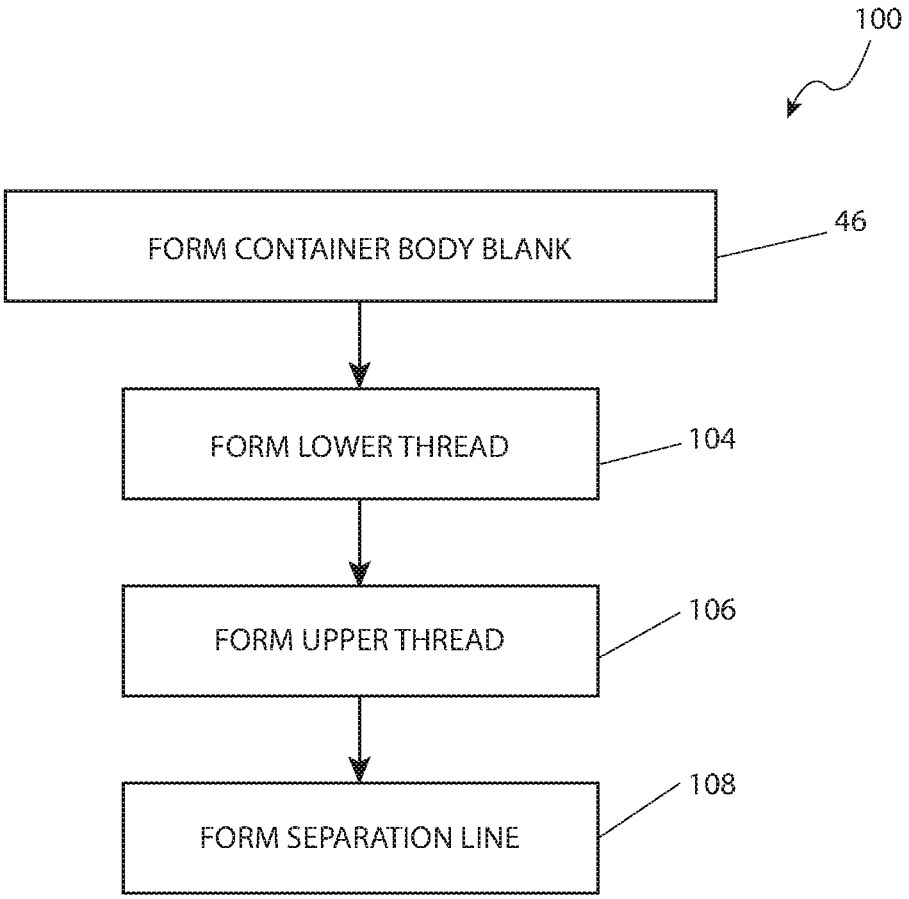
FIG. 6 is a flow diagram of an embodiment of the disclosed method for making the depth adjustable container; and, FIG. 7 is a schematic illustration of an embodiment of the disclosed method for making the depth adjustable container.
Figure 7:
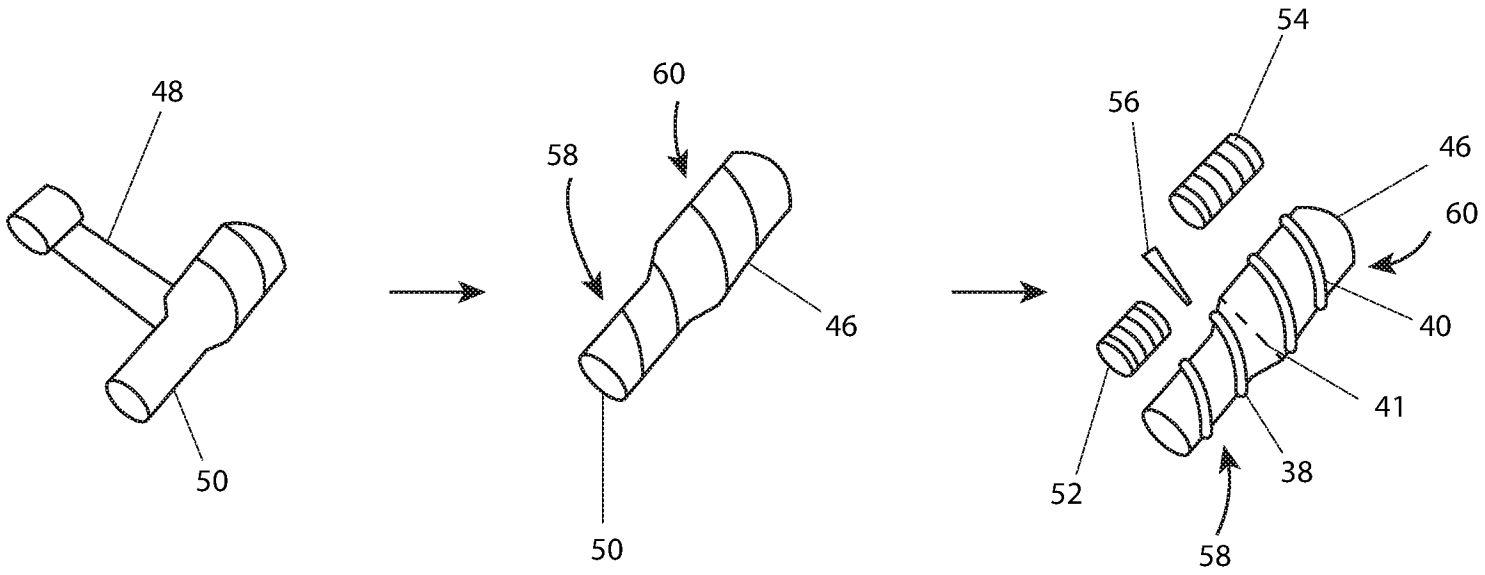

FIG. 6 is a flow diagram illustrating an embodiment of the disclosed method 100 for making the disclosed depth adjustable container (container 10) for perishable and/or non-perishable products 11. FIG. 7 is a schematic illustration of the disclosed method 100.

As shown at block 52, the method 100 may begin by forming a container body blank 46 (FIG. 7). As an example, the container body blank 46 is formed by wrapping strips of a sidewall material 48 (e.g., the paperboard), for example, provided from a roll, around a mandrel 50. As the strips of the sidewall material 48 are wrapped around the mandrel 50, seams between edges of adjacent strips of the sidewall material 48 are adhered (e.g., glued) together. The mandrel 50 has the same basic shape of the final container body 12. As an example, the mandrel 50 has a first section corresponding to the length and diameter of the lower section 34 of the container body 12 and a second section corresponding to the length and diameter of the upper section 36 of the container body 12.

The two (2) different diameters of the mandrel 50 corresponding to the lower section 34 and the upper section 36 of the container body 12 (FIGS. 2 and 3) may vary by approximately the wall thickness of the sidewall material 48. The center of the mandrel 50, where the two diameters of the mandrel 50 change, becomes the separation line 41 of the container body 12. A hard crease in the sidewall material 48 is created at the separation line 41 by stretching the sidewall material 48 over the mandrel 50 that has two (2) different diameters for the lower section 34 and the upper section 36. This separation line 41 is subsequently creased further and perforated by a roller 56 on the smaller diameter of the mandrel 50 at the separation line 41.

In an example embodiment, the sidewall material 48 is multi-layer and includes the necessary layers needed for perishable or non-perishable product 11, such as the barrier film 32 and/or the label 28 coupled to a surface of the sidewall material 48 prior to being applied to the mandrel 50. In another example embodiment, the barrier film 32 and/or the label 28 are coupled to a surface (e.g., an interior surface and/or an exterior surface) of the container body blank 48 after it has been completely formed on the mandrel 50.

As an example, the thread (lower thread 38 and upper thread 40) are formed in the sidewall of the container body blank 46 by stretching the sidewall material 48 over the mandrel 50 having pre-formed mating threads on the mandrel 50 used for creating the lower section 34 and the upper section 36 of the container body 12. As another example, rollers may be used to form the thread (lower thread 38 and upper thread 40) in the sidewall of the container body blank 46 to form the container body 12. As illustrated in FIG. 7, in an example implementation, at least one (1) first roller 52 is configured to form the lower thread 38 in the lower section 34 of the container body 12. At least one (1) second roller 54 is configured to form the upper thread 40 of the upper section 36 of the container body 12. At least one (1) third roller 56 is configured to form the separation line 41 in the container body 12 between the lower section 34 and the upper section 36.

As shown at block 104, the lower thread 38 is formed in the sidewall on a lower portion 58 of the container body blank 46. As an example, the first roller 52 may include at least one (1) or a series of deforming disks configured to press into and form a continuous crease in the sidewall 14 (e.g., the sidewall material 48). As the first roller 52 traverses the container body blank 46, the crease created in the sidewall 14 by the first roller 52 defines the alternating grooves and ridges of the lower thread 38. The first roller 52 is oriented at an angle relative to a longitudinal axis of the container body blank 46 such that the crease extends spirally around the container body blank 46 to form the lower thread 38.

As shown at block 106, the upper thread 40 is formed in the sidewall on an upper portion 60 of the container body blank 46. As an example, the second roller 54 may include at least one (1) or a series of deforming disks configured to press into and form a continuous crease in the sidewall 14 (e.g., the sidewall material 48). As the second roller 54 traverses the container body blank 46, the crease created in the sidewall 14 by the second roller 54 defines the alternating grooves and ridges of the upper thread 40. The second roller 54 is oriented at an angle relative to the longitudinal axis of the container body blank 46 such that the crease extends spirally around the container body blank 46 to form the upper thread 40.

As shown at block 108, the separation line 41 is formed in the sidewall between the upper portion 60 of the container body blank 46 and the lower portion 58 of the container body blank 46 (FIG. 7). As an example, the third roller 56 may include at least one (1) perforating disks, or blades, configured to perforate or score the sidewall 14 (e.g., the sidewall material 48).

After the lower thread 38, the upper thread 40 and the separation line 41 have been formed in the sidewall 14, the container body 12 is formed. The lower end closure 20 may then be coupled to the lower end 16 of the container body 12. Optionally, an exterior label 28 may be applied to the outside of the container body 12. As an example, the label 28 may be applied to the container body blank 46 before the third roller 56 forms the separation line 41. Following formation of the container body 12, as described above, the product 11 may be positioned within the container body 12 and the upper end closure 22 may be coupled to the upper end 18 of the container body 12.

The exact specifications, materials used, and method of use may vary upon manufacturing. The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplate.

What is claimed is:

1. A container comprising:

a container body comprising an upstanding, tubular sidewall having a first end and a second end;

a first threaded section formed in the sidewall and located adjacent the first end;

a second threaded section formed in the sidewall and located adjacent the second end;

a separation line formed in the sidewall between the first threaded section and the second threaded sections;

a first end closure connected to the first end of the container body;

a second end closure connected to the second end of the container body;

a barrier film connected to an inner surface of the sidewall;

a label connected to an outer surface of the sidewall; and, a lid; and wherein:

the first threaded section is capable of mating with the second threaded section; and, the container body is capable of holding product in a stacked configuration.

2. The container of claim 1, further comprising a polymer coating applied to at least one of the inner surface of the sidewall and the outer surface of the sidewall.

3. The container of claim 1, wherein the barrier film comprises a polymer film.

4. A container comprising:

a container body comprising a tubular sidewall, wherein the container body further comprises:

a first section comprising first thread formed in the tubular sidewall;

a second section comprising second thread formed in the tubular sidewall;

a separation line formed in the sidewall defining the first section and the second section of the container body; and wherein:

the container body is configured to separate along the separation line;

with the first section and the second section separated from one another, the first section is receivable by the second section and the first threads mate with the second threads; and, a length of the container body is adjustable by rotation of the first section relative to the second section.

5. The container of claim 4, wherein the container body is made from a fiber material.

6. The container of claim 4, further comprising a barrier film connected to at least one of an inner surface and an outer surface of the sidewall, and wherein the barrier film is configured to prevent passage of air and moisture through the sidewall.

7. The container of claim 6, wherein, with the first section received by the second section, the barrier film is positioned between the first thread and the second thread.

8. The container of claim 6, wherein the barrier film comprises a polymer film.

9. The container of claim 6, wherein the barrier film comprises a metallic foil.

10. The container of claim 9, further comprising a polymer coating applied to the metallic foil.

11. The container of claim 4, wherein the container body is made from a metallic material.

12. The container of claim 4, further comprising a label connected to an exterior surface of the sidewall.

13. The container of claim 4, further comprising:

a first end closure connected to a first end of the sidewall; and, a second end closure removably connected to a second end of the sidewall;

wherein the first end closure and the second end closure enclose an interior volume of the container body.

14. The container of claim 13, further comprising a lid removably connected to the second end of the sidewall.

15. The container of claim 4, wherein:

the first section of the container body has a first external dimension;

the second section of the container body has a second external dimension; and, the first external dimension is less than the second external dimension.

16. The container of claim 15, wherein:

the sidewall has a thickness; and, a difference between the first external dimension and the second external dimension is equal to the thickness.

17. A method for making a container, the method comprising:

forming a container blank;

forming first threads in the container blank;

forming second threads in the container blank; and, forming a separation line in the container blank to define a first section having the first threads and a second section having the second threads.

18. The method of claim 17, wherein forming the container blank comprises:

wrapping strips of a sidewall material around a mandrel; and, adhering seams between edges of adjacent ones of the strips of sidewall material.

19. The method of claim 18, wherein:

forming the first threads in the container blank comprises pressing a first roller into a first section of the strips of sidewall material; and, forming the second threads in the container blank comprises pressing a second roller into a second section of the strips of sidewall material.

20. The method of claim 19, wherein forming the separation line in the container blank comprises pressing a third roller into the strips of sidewall material between the first threads and the second threads.

* * * * *